US010130869B2

(12) United States Patent
Finnerty et al.

(10) Patent No.: US 10,130,869 B2
(45) **Date of Patent: *Nov. 20, 2018**

(54) SCRATCH-OFF GAMES WITH VARIABLE REVEAL FEATURE

(71) Applicant: Hydra Management LLC, New York, NY (US)

(72) Inventors: Fred W. Finnerty, Dawsonville, GA (US); Kenneth E. Irwin, Jr., Dawsonville, GA (US)

(73) Assignee: Hydra Management LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/244,147

(22) Filed: Aug. 23, 2016

(65) Prior Publication Data

US 2017/0209782 A1 Jul. 27, 2017

Related U.S. Application Data

(60) Provisional application No. 62/281,811, filed on Jan. 22, 2016.

(51) Int. Cl.

| | |
|---|---|
| ***A63F 1/18*** | (2006.01) |
| ***A63F 3/06*** | (2006.01) |
| ***B42D 25/27*** | (2014.01) |

(52) U.S. Cl.

CPC ..... *A63F 3/0665* (2013.01); *A63F 3/062* (2013.01); *A63F 3/0655* (2013.01); *B42D 25/27* (2014.10)

(58) Field of Classification Search

CPC ..... A63B 71/00; A63F 1/18

(Continued)

(56) References Cited

U.S. PATENT DOCUMENTS 4,095,824 A * 6/1978 Bachman ..... A63F 3/0665 273/139
4,726,608 A * 2/1988 Walton ..... A63F 3/0665 273/139

(Continued)

FOREIGN PATENT DOCUMENTS

CA 2015351 A1 10/1991
CA 2359581 A1 1/2002

(Continued)

OTHER PUBLICATIONS

"States Consider Slapping Limits on Their Lotteries," Jake Grovum, The Pew Charitable Trusts, Apr. 2, 2015, downloaded from webpage: <http://www.pewtrusts.org/en/research-and-analysis/blogs/stateline/2015/4/02/states-consider-slapping-limits-on-their-lotteries>.

(Continued)

*Primary Examiner* — John E Simms, Jr.
*Assistant Examiner* — Dolores Collins
(74) *Attorney, Agent, or Firm* — Panitch Schwarze Belisario & Nadel LLP

(57) ABSTRACT

A security-enhanced document includes a substrate; at least one lower portion of graphic imaging with or without first variable indicia directly or indirectly digitally imaged on the substrate; at least one release coat applied over the lower portion; at least one SOC applied over the release coat to maintain the lower portion imaging unreadable until removal of the SOC; and at least one overprint upper portion with digital imaging of second variable indicia over the SOC, the overprint upper portion being registered to cover at least a part of the imaging of the lower portion, the overprint upper portion being associated with the lower portion, such that the upper portion has at least one associated feature imaged with respect to a visual or thematic aspect of the lower portion. The document enhances the (Continued)

popularity and fun of games using the document, and may expand the consumer base for the games.

10 Claims, 14 Drawing Sheets

(58) Field of Classification Search
USPC ..... 273/139
See application file for complete search history.

(56) References Cited

U.S. PATENT DOCUMENTS 5,158,293 A 10/1992 Mullins
5,213,664 A * 5/1993 Hansell ..... D21H 21/40 162/134
5,282,651 A * 2/1994 Alonso ..... A63F 3/0685 283/117
5,286,061 A 2/1994 Behm
5,313,664 A 5/1994 Sugiyama et al.
5,407,535 A 4/1995 Hansell
5,431,452 A 7/1995 Chang et al.
5,544,881 A 8/1996 Rua, Jr. et al.
5,569,512 A * 10/1996 Brawner ..... A63F 3/0665 283/100
5,667,250 A * 9/1997 Behm ..... A63F 3/0665 283/102
5,704,647 A * 1/1998 Desbiens ..... A63F 3/0665 283/67
5,707,647 A 1/1998 Dunn et al.
5,803,504 A 9/1998 Deshiens et al.
5,887,906 A 3/1999 Sultan
6,076,860 A 6/2000 Holman et al.
6,145,885 A 11/2000 Scrymgeour et al.
6,270,406 B1 8/2001 Sultan
6,347,794 B2 2/2002 Scrymgeour et al.
6,379,742 B1 * 4/2002 Behm ..... A63F 3/0665 427/261
6,557,851 B2 5/2003 Gauthier et al.
6,939,627 B2 9/2005 Morizumi et al.
7,070,054 B2 7/2006 Scrymgeour et al.
7,410,168 B2 8/2008 Gumina
7,429,044 B2 9/2008 O'Brien
7,431,295 B2 10/2008 Scrymgeour et al.
7,455,323 B2 11/2008 Taylor et al.
7,472,926 B2 1/2009 Friesen et al.
7,562,626 B2 7/2009 Morizumi et al.
7,624,984 B2 12/2009 Martineck, Sr.
7,637,212 B2 12/2009 Morizumi et al.
7,665,732 B2 2/2010 Stephens
7,674,501 B2 * 3/2010 Raksha ..... B05D 3/207 427/202
7,681,884 B2 3/2010 Scrymgeour et al.
7,712,741 B2 5/2010 Lambert
7,720,421 B2 5/2010 Snyder
7,748,712 B2 7/2010 Sobel et al.
7,914,371 B2 3/2011 O'Brien
7,922,178 B2 4/2011 Finocchio
7,959,188 B2 6/2011 Martineck, Sr.
7,980,559 B2 7/2011 Miller et al.
7,982,917 B2 * 7/2011 Wicker ..... B42D 25/30 235/494
8,074,570 B2 12/2011 Grotkowski et al.
8,221,213 B2 7/2012 Martineck, Sr.
8,251,285 B2 * 8/2012 Kingsborough ..... B42D 15/045 235/375
8,342,576 B2 1/2013 Eschbach et al.
8,628,082 B2 1/2014 Martineck
8,638,479 B2 * 1/2014 Irwin, Jr. ..... B60R 1/084 356/433
8,857,816 B2 10/2014 Martineck, Sr.
8,883,390 B1 11/2014 Tyagi et al.
2002/0047259 A1 * 4/2002 Lambert ..... A63F 3/0665 283/49
2004/0176158 A1 9/2004 Baldwin
2005/0167910 A1 * 8/2005 Candler ..... A63F 3/0665 273/138.1
2005/0258634 A1 * 11/2005 Dronzek, Jr. ..... B32B 27/08 283/72
2007/0164559 A1 7/2007 Kozdras
2007/0281224 A1 12/2007 Kirk et al.
2010/0045026 A1 2/2010 Napolitano et al.
2010/0218693 A1 * 9/2010 Kozdras ..... A63F 3/0655 101/450.1
2010/0253063 A1 * 10/2010 Skogster ..... A63F 3/0665 283/100
2012/0025516 A1 2/2012 Miller et al.
2012/0267888 A1 * 10/2012 Behm ..... A63F 3/0665 283/100
2014/0356537 A1 12/2014 Tyagi et al.

FOREIGN PATENT DOCUMENTS

CA 2421241 A1 8/2003
CA 2541152 A1 6/2006
EP 0974951 A2 1/2000
WO 2001023054 A1 4/2001
WO 2010130041 A1 11/2010

OTHER PUBLICATIONS

"Lotteries: America's $70 Billion Shame," Derek Thompson, The Atlantic, May 11, 2015, downloaded from webpage: <http://www.theatlantic.com/business/archive/2015/05/lotteries-americas-70-billion-shame/392870/>.
"Historic Powerball Jackpot Fans Anti-Gambling Advocates' Fears," Tony Cantu, East Austin Patch, Jan. 12, 2016, downloaded from webpage: <http://patch.com/texas/eastaustin/historic-powerball-jackpot-fans-anti-gambling-advocates-fears>.
Int'l Search Report dated Mar. 30, 2017 in Int'l Application No. PCT/US2017/014580.
Int'l Search Report dated Mar. 29, 2017 in Int'l Application No. PCT/US2017/014589.
Written Opinion dated Dec. 20, 2017 in Int'l Application No. PCT/US2017/014580.
International Preliminary Report on Patentability dated May 8, 2018 in International Application No. PCT/US2017/014580.
International Preliminary Report on Patentability dated May 8, 2018 in International Application No. PCT/US2017/014589.

* cited by examiner

SCRATCH-OFF GAMES WITH VARIABLE REVEAL FEATURE

CROSS-REFERENCE TO RELATED APPLICATION

This application claims the benefit of U.S. Patent Application No. 62/281,811, filed Jan. 22, 2016, the disclosure of which is hereby incorporated herein by reference in its entirety.

FIELD OF THE INVENTION

The present invention relates generally to instant (scratch-off) games, such as lottery tickets, having indicia under a Scratch-Off Coating (SOC), and more particularly to methods for enhancing play value of the instant games while also adding to the aesthetics.

BACKGROUND

Lottery games have become a time honored method of raising revenue for state and federal governments the world over. Traditional scratch-off and draw games have evolved over decades, supplying increasing revenue year after year. However, after decades of growth, the sales curves associated with traditional games seem to be flattening out. This flattening of lottery sales curves is typically attributed to a fixed base of consumers that routinely purchase lottery products with very few new consumers choosing to participate in the lottery marketplace. Various analyses of state lottery sales data tend to support the hypothesis that lotteries rely heavily on an existing consumer base and more specifically on lottery "super users." Three states (Rhode Island, South Dakota and Massachusetts) had 2014 lottery sales that topped $700 per capita. While ten states had per capita sales below $100, per capita sales for all state lotteries averaged almost $250. Demographically speaking, this existing base of lottery consumers is aging with younger consumers showing very little interest in participating in existing lottery offerings. Thus, the potential for ever-increasing lottery sales is increasingly problematic with the existing fixed base of consumers saturated. Consequently, both lotteries and their service providers are presently searching for new forms of gaming.

In addition to flattening sales, a static lottery consumer base is often cited as exploiting problem gamblers with various legislatures debating restrictions or probations being placed on lotteries. For example, "Stop Predatory Gambling", which advocates an end to state-sponsored gambling recently stated: "State lotteries have a business model that's based on getting up to 70 to 80 percent of their revenue from 10 percent of the people that use the lottery . . . " In Minnesota, a pending bipartisan bill would require 25% of lottery billboards to be dedicated to a warning about the odds of winning, cautions about addiction, and information on where problem gamblers can seek help.

In an attempt to diversify their base and increase sales, United States Lotteries have come to appreciate the virtues of producing games with more entertainment value that can be sold at a premium price. For instance, ten-dollar instant ticket games with higher paybacks and more ways to win now account for over $5 billion a year in United States lottery sales. But by their nature, high-volume, generic, higher priced instant games with higher prizes are a minor part of overall game offerings and although they have their place, they have limited potential for assisting in consumer base diversification. Additionally, these higher priced and high-volume games also typically add little unique entertainment value relative to lower priced instant tickets and consequently do not to attract many new consumers.

Thus, it is highly desirable to develop gaming systems methodologies that provide methods of playing new gaming opportunities, particularly more customized and consequently smaller volume games. Ideally these gaming methodologies should allow for flexibility and creativity for game designers to tailor games to a wide variety of small targeted segments previously not served by existing gaming offerings, thereby appealing to a broader base of consumers.

SUMMARY OF THE INVENTION

Objects and advantages of the invention will be set forth in part in the following description, or may be apparent from the description, or may be learned through practice of the invention.

One aspect of the invention relates to a security-enhanced document comprising: a substrate; at least one lower portion of graphic imaging with or without first variable indicia directly or indirectly digitally imaged on the substrate; at least one release coat applied over the lower portion; at least one SOC applied over the release coat to maintain the lower portion imaging unreadable until removal of the SOC; and at least one overprint upper portion with digital imaging of second variable indicia over the SOC, the overprint upper portion being registered to cover at least a part of the imaging of the lower portion, the overprint upper portion being associated with the lower portion, such that the upper portion has at least one associated feature imaged with respect to a visual or thematic aspect of the lower portion.

A second aspect of the invention relates to the document as in the first aspect, wherein the imaging of the upper and lower portions is maintained within plus-or-minus 0.01 inch (0.254 mm) registration of each other.

A third aspect of the invention relates to the document as in the first aspect, wherein the imaging of the upper and lower portions is comprised of process colors.

A fourth aspect of the invention relates to the document as in the third aspect, wherein the lower portion imaging includes the first variable indicia and the upper portion includes the second variable indicia, the lower portion imaging and the upper portion imaging including an outline around the indicia to ensure legibility to colorblind individuals.

A fifth aspect of the invention relates to the document as in the first aspect, wherein the imaging of the upper and lower portions is comprised of digitally imaged spot colors.

A sixth aspect of the invention relates to the document as in the fifth aspect, wherein the lower portion imaging includes the first variable indicia and the upper portion includes the second variable indicia, the lower portion imaging and the upper portion imaging including an outline around the indicia to ensure legibility to colorblind individuals.

A seventh aspect of the invention relates to the document as in the first aspect, wherein the document is a scratch-off game piece with the lower portion imaging including the first variable indicia, wherein the first variable indicia may have matching indicia that represents a value, such that the matching indicia of the lower portion represent a game win pursuant to game rules in game play.

An eighth aspect of the invention relates to the document as in the seventh aspect, wherein the value is based on game rules and is a prize pursuant to predetermined game rules.

A ninth aspect of the invention relates to the document as in the seventh aspect, wherein the imaging of the upper and lower portions is a part of the game play and related to the value.

A tenth aspect of the invention relates to the document as in the ninth aspect, wherein the imaging of the upper and lower portions provides a marker system indicating correct game play.

An eleventh aspect of the invention relates to the document as in the seventh aspect, wherein the imaging of the upper and lower portions is independent of the game play.

In accordance with the above and other aspects of the invention, secure documents, such as instant games, are created using variable imaging below and above the SOC. The variable imaging below the SOC is referred to in various instances in this description and claims as the at least one lower portion imaging with graphic imaging and with or without first variable indicia, the lower portion imaging being directly or indirectly digitally imaged on the substrate. Sometimes the variable imaging below the SOC is referred to in shorthand as the lower portion imaging or just the lower portion. The variable imaging above the SOC is referred to in various instances in this description and claims as the at least one overprint upper portion with digital imaging and with or without second variable indicia over the SOC. Sometimes the variable imaging above the SOC is referred to in shorthand as the overprint upper portion imaging or just as the upper portion imaging or just the overprint upper portion or just the overprint. By virtue of the overprint upper portion being registered to cover at least a part of the imaging of the lower portion, a transitional reveal of the lower portion variable indicia occurs as the overprint upper portion imaging and SOC are gradually removed. This transitional reveal can be for amusing purposes or a strategic part of game play.

In a first embodiment, the overprint upper portion imaging and the lower portion imaging are incorporated in an amusing reveal display apart from the actual game play of an instant lottery ticket. The upper portion imaging, which can or need not cover all of the lower portion imaging, enables the non-gaming reveal of the lower portion imaging to differ from ticket to ticket, thereby creating variety and anticipation until the SOC is removed and the lower image is revealed. Thus, with this reveal feature, tickets can be sold with hidden "Easter Eggs" (discoverable lower imaging unknown to the consumer) that only become apparent after the ticket has been sold and the ticket is played. This non-gaming reveal display embodiment thereby adds value to the instant ticket gaming experience by adding an additional play element to the ticket that can vary over a very large range of tickets. Since the additional play element is independent of the gaming portion there is no impact on the prize fund associated with the feature.

In another embodiment, the upper portion imaging and the lower portion imaging reveal are incorporated as part of the instant ticket's game play to either enhance the play experience or to enable different styles of play that heretofore were not possible with conventional fixed plate presses coupled with monochromatic low resolution (e.g., 240 dpi) digital imaging. This embodiment could also include an "Easter Egg" type reveal as disclosed in the first embodiment, only in this second embodiment the "Easter Egg" revealed would be associated with a prize. The essential difference between the two embodiments is whether the variable imaging reveal is incorporated into game play (and consequently, is part of the prize fund) or is included only as an entertaining feature that potentially increases the perceived value of the instant game without debiting the prize fund.

In another embodiment, the overprint upper portion is associated with (sometimes referred to herein as "synchronized" with) the lower portion, such that the upper portion has at least one associated feature imaged with respect to a visual or thematic aspect of the lower portion. As a result, by gradually removing upper portion imaging and the SOC, the lower portion imaging is revealed, such that the upper portion imaging appears to dissolve visually or thematically into the lower portion imaging from the consumer's perspective. The principal advantage of this embodiment is the perceived enhanced value of the dissolve reveal. This of particular interest where the upper portion imaging and the lower portion imaging are visually related.

In all of these embodiments, the variable imaging reveal is incorporated with the use of at least two different color digital imagers—i.e., one digital imager for printing the reveal variable imaging hidden under the SOC until played and one digital imager for printing a variable image reveal on top of the SOC visible on unsold tickets. While it is theoretically possible to produce a type of instant ticket reveal using the traditional fixed plate printing techniques typically employed by lottery printers, the reveal mechanism would be severely limited in variety since the total number of variations would be limited to one cylinder (i.e., plate) rotation, which is typically between five to ten variations per rotation. With this invention of variable digital imaging reveals, the total number of variations becomes virtually unlimited, thereby enabling multiple designs and game plays. Additionally, by incorporating high resolution color variable digital imaging reveal play, the distribution of key variable imaging and indicia can be extremely wide, and consequently rare, thereby enhancing the perceived and/or actual value of any ticket with the key imaging or indicia.

Described are a number of mechanisms and methodologies that provide practical details for reliably producing variable reveal imaging across multiple games. Although the examples provided herein are primarily related to instant lottery tickets, it is clear that the invention is applicable to any type of small number specialized games (e.g., American Legion Post drawing, telephone cards, activation cards, etc.) or other security-enhanced documents that include a SOC.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
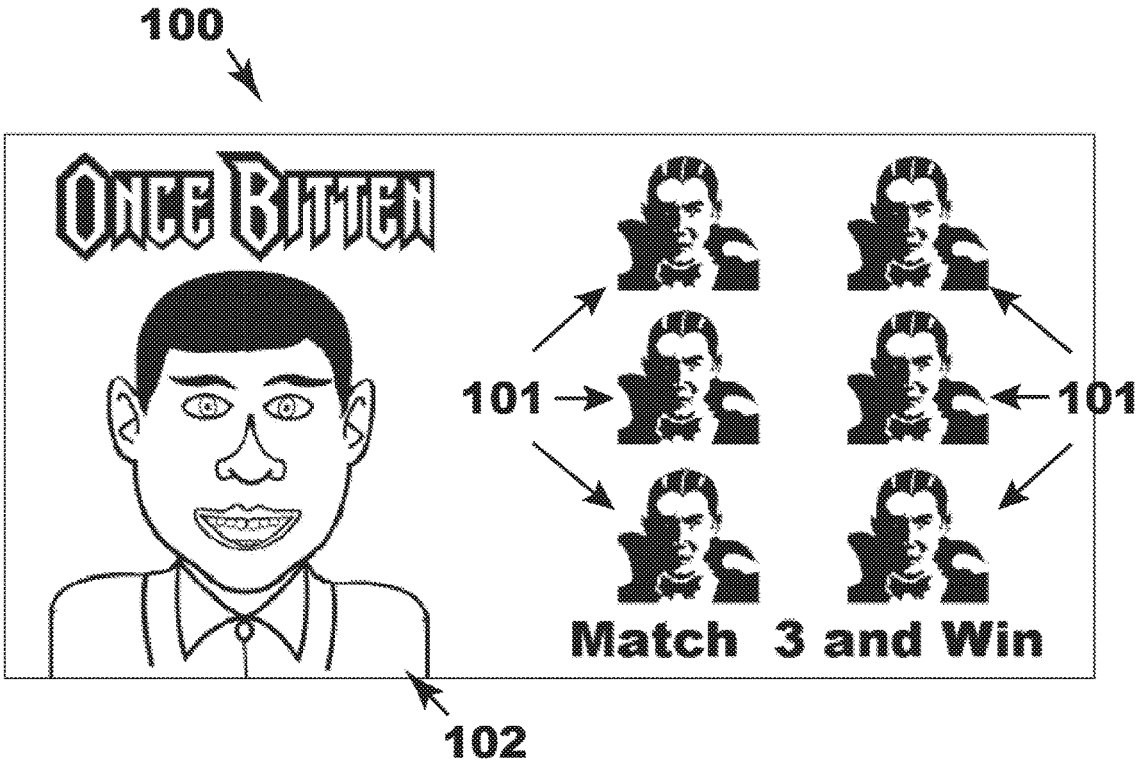
FIG. 1 is a top plan view of a first representative example of a variable reveal game where the reveal feature is not part of the actual game play with its SOC intact.

Reference will now be made in detail to examples of the invention, one or more embodiments of which are illustrated in the drawings. Each example is provided by way of explanation of the invention, and not meant as a limitation of the invention. For example, features illustrated or described as part of one embodiment may be used with another embodiment to yield still a further embodiment. It is intended that the present invention encompasses these and other modifications and variations as come within the scope and spirit of the invention.

In the context of this invention the term "variable imaging," refers to methods of printing from a digital-based image directly to a variety of documents having a SOC (e.g., instant lottery ticket). Thus, as its name implies, "variable imaging" can vary from document-to-document and may include text, icons, drawings, photographs, etc. Any of the commercially available off-the-shelf digital printers (e.g., Memjet, Hewlett Packard—"HP"—Indigo, Xerox CiPress series, etc.) are capable of performing the "variable imaging" as described by this invention.

FIG. 1 illustrates a first embodiment of an exemplary top plan view variable reveal game 100 with its overprint upper layer imaging and SOC intact—i.e., in a pristine, unsold condition. As illustrated in the figure, in embodiment 100, the six "Match 3 and Win" game play overprints 101 are a traditional instant ticket implementation where removal of the SOC simply discloses the game play first variable indicia that are not necessarily synchronized with the overprint image. Nevertheless, embodiment 100 also includes a variable reveal feature 102 that is not part of the actual game play—i.e., feature 102 does not influence the game outcome, but is imaged for amusement purposes only. While the upper (i.e., imaged on top of the SOC) reveal image 102 of FIG. 1 is illustrated as a line drawing of a young man, it is understood that this feature would be comprised of digitally imaged process color or spot color(s) and can vary from ticket-to-ticket illustrating other images (e.g., young woman, old man, old woman, etc.), or in some embodiments remain essentially the same from ticket-to-ticket.

Figure 2:
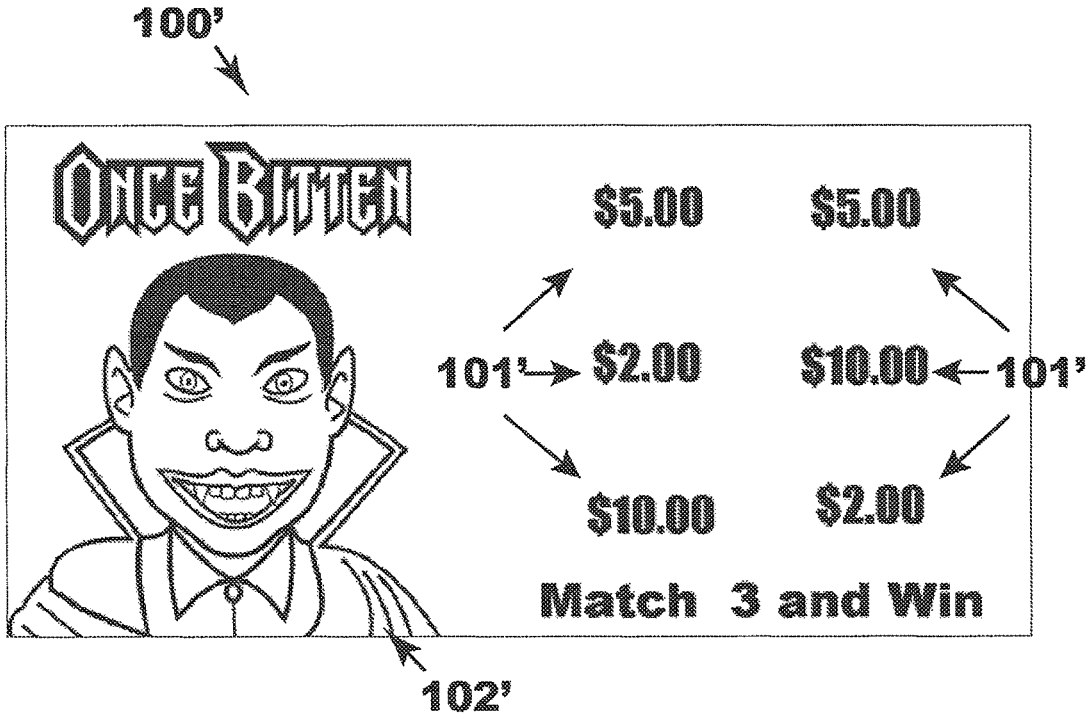
FIG. 2 is a top plan view of the first representative example of FIG. 1 with its SOC completely removed.

FIG. 2 illustrates the same exemplary top plan view of FIG. 1 of the first embodiment 100 with all of its SOC removed 100' revealing the typical win or lose indicia 101' of a standard instant ticket as well as the process color variable reveal digital image 102'. Notice that the upper reveal image 102 changes from a young man 102 (FIG. 1) (i.e., above the SOC) to a vampire 102' (FIG. 2) in the lower portion image (i.e., beneath the SOC). This is an example of both the visual and thematic association of the upper portion imaging and the lower portion imaging mentioned above. By imaging both the upper and lower reveal features with the same digitally imaged process color or spot color(s) printing techniques, the effect that the consumer visually perceives is a dissolve from the upper feature 102 to the lower feature 102' as he or she gradually removes the SOC.

Figure 3:
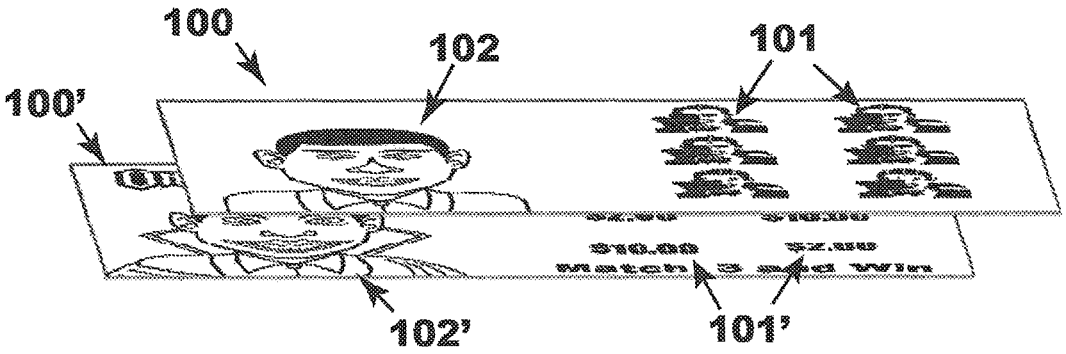
FIG. 3 is an exploded top front isometric schematic view of the representative examples of FIG. 1 and FIG. 2 illustrating the positioning of the upper variable reveal overprint with respect to the lower variable reveal indicia.

For the dissolve effect to be perceived correctly, both the upper and lower features must be substantially aligned with each other. FIG. 3 provides an exploded isometric top front drawing of the first embodiment with intact upper layer 100 and its associated lower layer 100' with the upper reveal feature 102 substantially aligned with its corresponding lower reveal feature 102'. Thus, for a reveal to effectively dissolve from an upper feature 102 to a lower feature 102', registration between the upper and lower layers is critical. In a preferred embodiment, the registration between the upper feature 102 and the lower feature 102' should be within plus-or-minus 0.01 inch (0.254 mm). With typical instant ticket presses with fixed plate overprint features, maintaining ±0.01 inch tolerance between the upper feature 102 and the lower feature 102' would be problematic at best. However, with the use of digital imagers utilizing process colors in this embodiment, the upper and lower imagers can readily maintain this level of registration. It should be noted that with traditional overprints 101 and instant ticket variable indicia 101' indicative of win or lose in game play, resolution requirements are substantially relaxed and are typically an order of magnitude or more less precise. This is because traditional fixed plate printing presses are large in size with extremely long paper paths—e.g., 6,000 linear feet (≈1,829 meters). These long paper paths cause the paper to alter its shape as it is heated, cooled, and pulled through the press. Coupled with the problems associated with maintaining mechanical registration from unit to unit within the press line, it can be readily understood how maintaining the desired level of registration for a dissolve effect would be problematic utilizing traditional (fixed plate) presses.

Figure 4:
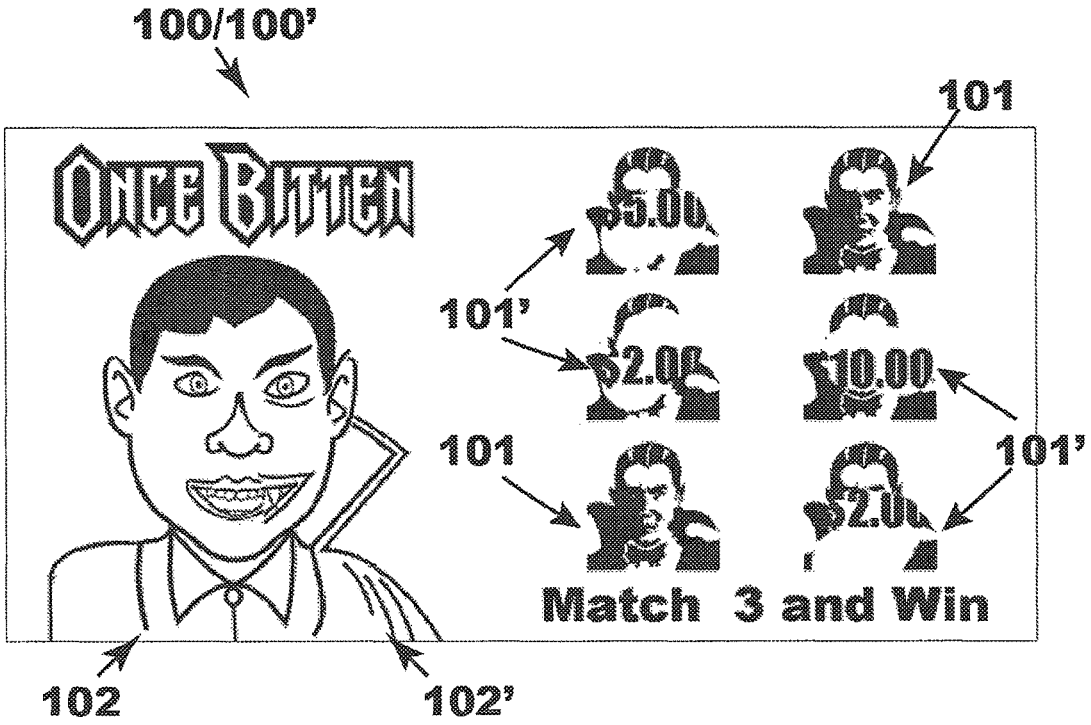
FIG. 4 is a top plan view of the first representative examples of FIG. 1 and FIG. 2 with the upper variable reveal overprint and associated SOC partially removed.

FIG. 4 illustrates a partial SOC removal of the overprint upper portion imaging or reveal feature 102, emphasizing a portion of the lower portion imaging or reveal feature 102'. As illustrated in FIG. 4, the dissolve effect becomes apparent as the SOC is gradually removed. Also notice in FIG. 4 that partial upper portion imaging and SOC removal with the traditional overprints 101 and the lower portion variable indicia 101' results in no dissolve effect, since there is no visual or thematic association between them, unlike the visual and thematic association of the overprint upper portion imaging 102 and the lower portion digital imaging 102'. Thus, the essential concept is that the upper and lower reveal features are two full sets of high resolution digitally imaged graphics on the ticket, where the transition reveal graphic (i.e., the lower graphic) is revealed by rubbing off the primary (i.e., upper) graphic printed on top of the SOC. In the embodiments of dissolve effects, registration between the upper and lower reveal features is critical.

Of course, there are other embodiments of variable reveal features that are also not an integral part of instant game play dynamics. For example, it has long been a tradition for lottery tickets to motivate sales through display graphics. Variable imaging systems display art are capable of printing every ticket in a book of tickets as a unique graphic. Consumers may want a specific image and refuse to purchase a ticket unless the desired image is present. To solve this problem, the display art can be printed below the SOC with a second more generic display graphic printed on top of the SOC. In an example of this embodiment, books of tickets could be printed with images of players, cheerleaders, or a coach of a high school football team printed under the SOC, while the school's name and team mascot would be printed above the SOC. The generic graphic of the school's name and mascot would prompt people living in the school district to support their team and purchase tickets—e.g., parents and family members of those depicted on the tickets would be especially motivated to acquire tickets of their family member. Specific individual tickets could be acquired by trading tickets, group purchases such as team boosters, which would purchase an entire pack, then divide the pack between the pool of purchasers, Facebook trading pages, or individuals could purchase entire books of tickets as keepsakes of the team.

In accordance with the present invention, the significant concept is that the desired lower portion imaging is hidden from view with all unsold tickets due to the SOC overprint. Thus, only after the ticket is purchased and the SOC is removed, does the consumer gain any knowledge of the lower portion, thereby eliminating consumer "cherry picking" of unsold tickets.

All of the previous embodiments utilize a variable reveal display as a separate feature from the actual game play of an instant lottery ticket. The variable imaging enables the non-gaming reveals to differ from ticket-to-ticket. These non-gaming reveal-embodiments thereby add value to the instant gaming experience by adding additional play elements that can vary over a large range of tickets. These same reveal features (e.g., dissolve, specifically desirable images or graphics, etc.) may be incorporated directly into game play where the reveal function outcome influences the prize won (e.g., a ticket with a dissolve reveal that turns a person into a vampire doubles the prize won). There are embodiments where creating a digitally imaged full color or spot color reveal via upper portion imaging and SOC removal can directly enhance existing game play.

Figure 5:
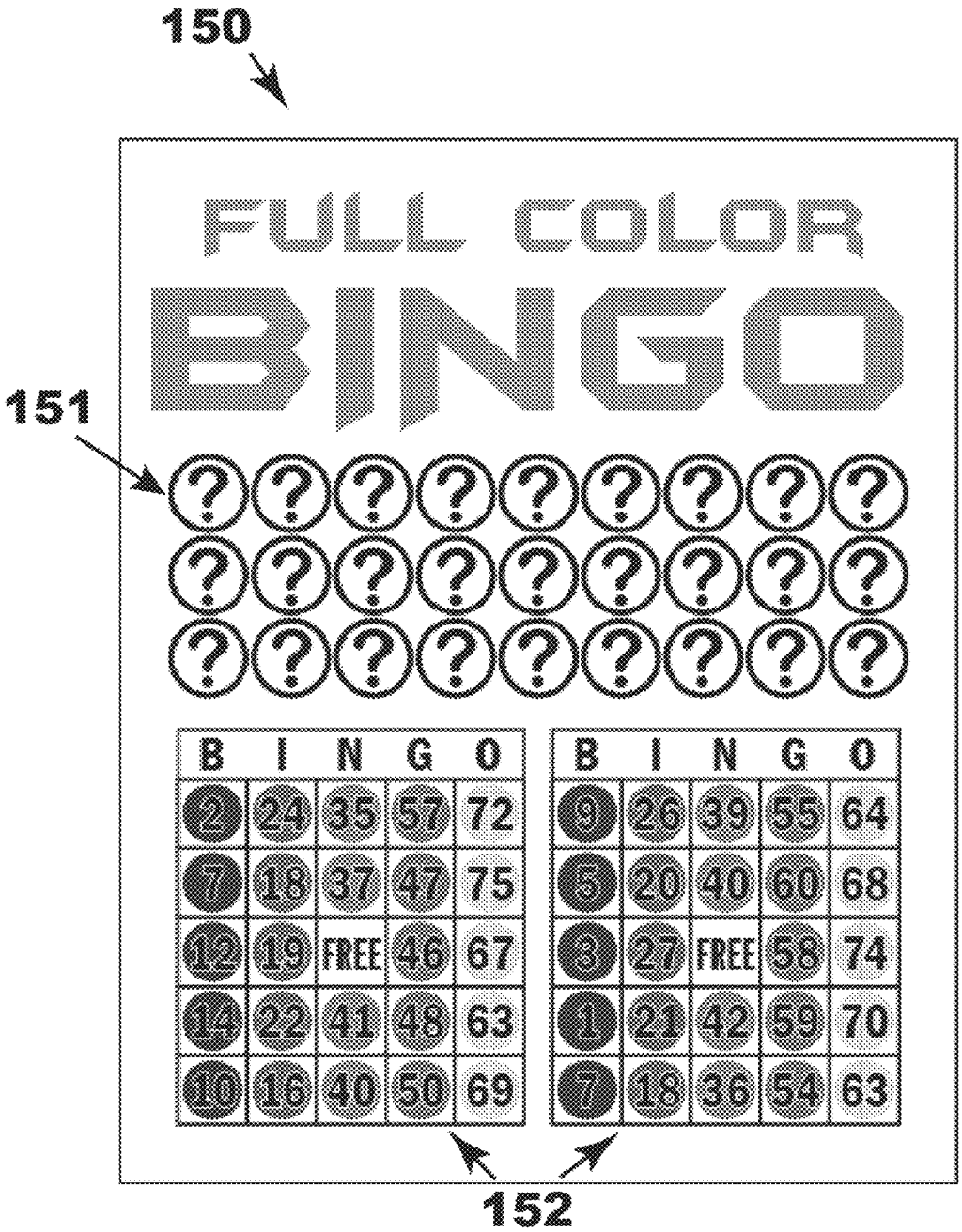
FIG. 5 is a top plan view of a representative example of a variable reveal Bingo game where the reveal feature is part of the actual game play with its SOC intact.

FIG. 5 illustrates one such embodiment of an enhancement 150 of the classic Bingo instant game currently being sold. With the classic game, call numbers are typically unscratched one by one in any number of play cards where the call number appears. Winning is accomplished by matching a series of numbers on any play card with the value of the win determined by the pattern of matches—e.g., horizontal, vertical, and diagonal lines; four corners, full card, etc., according to predetermined rules of the particular game being played.

The embodiment 150 enhances this game play by printing tickets with two sets of high resolution digital process or spot color imagers, one for digital imaging below the SOC and one for digital imaging above the SOC. In contrast, traditional Bingo instant tickets utilize a single low resolution monochromatic inkjet imager with some type of marking system for the play cards. In the present invention, with the embodiment 150, the dual digital color imaging (i.e., above and below the SOC) enable the call and play numbers to be color coded, which will be shown is helpful in the matching of call numbers to the play numbers. For example, for people with poor vision, SOC tickets with Bingo games are particularly difficult to play, because (due to space limitations on the ticket 150 the simulated game card numbers 152 that are part of the ticket) it is common to have the letter associated with the call number printed with a very small font. This small font size is often difficult to read, but the addition of having a color associated with the letter eliminates the need to read the letter. FIG. 5 illustrates the embodiment 150 imaged on a pristine (i.e., unsold and unplayed) instant Bingo game ticket. As shown in the figure, the call numbers 151 are hidden by a SOC and overprint (in the form of question marks, for instance in the illustrated embodiment) with the play card color-coded numbers 152 of the ticket 150 displayed. With this embodiment, the play cards are varied from ticket-to-ticket, with the variable numbers and associated color-coding printed by an upper digital color imager.

Figure 6:
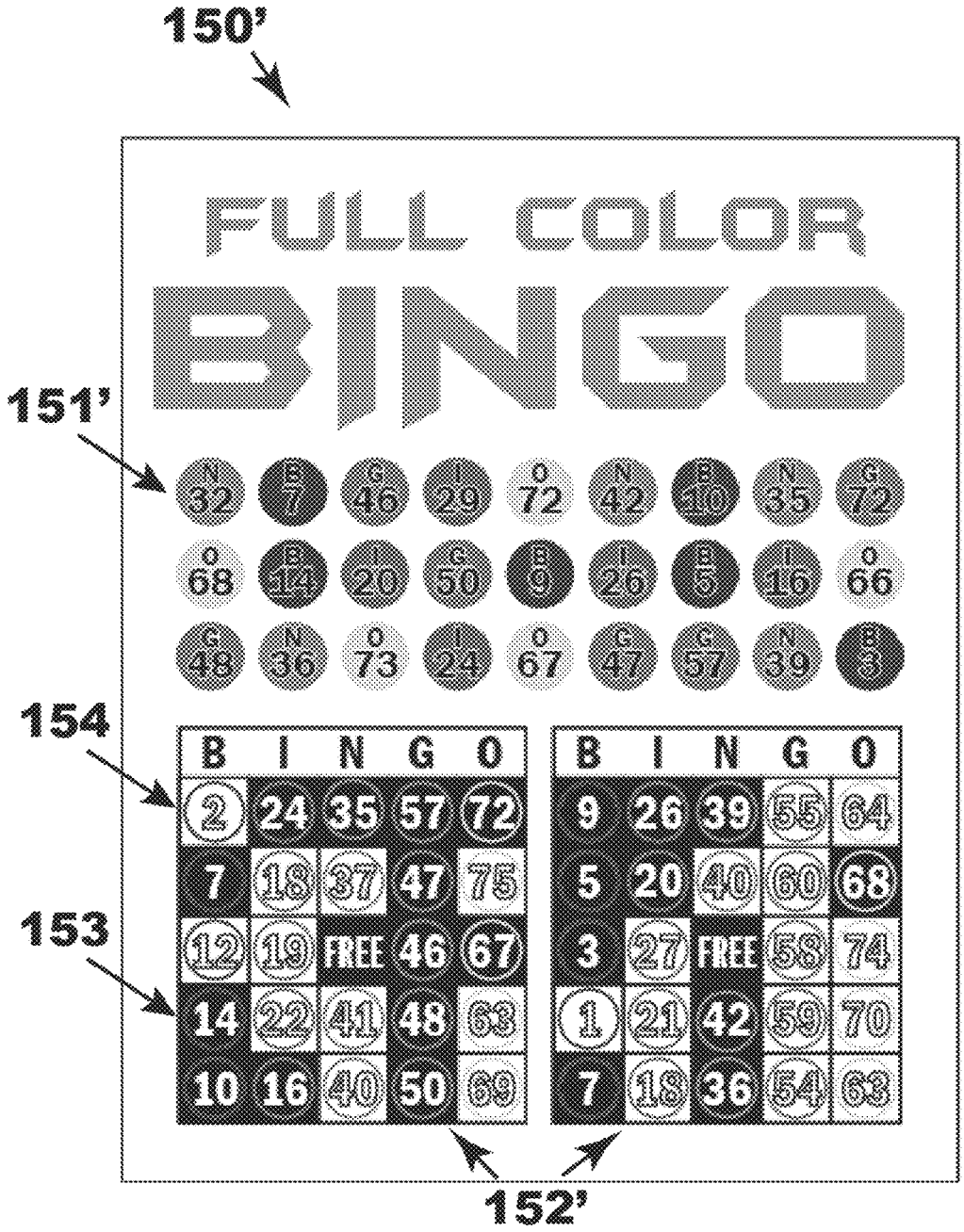
FIG. 6 is a top plan view of the representative example of FIG. 5 with its SOC completely removed.

FIG. 6 illustrates the same exemplary ticket 150 of FIG. 5, but with all of the upper imaging and the SOC removed in the ticket 150' of FIG. 6. The call numbers 151' are now visible with the play cards numbers 152' displaying when as correctly scratched marker indicia number 153 or incorrectly scratched marker indicia number 154. In this embodiment, when a play card indicia number is scratched correctly, the indicia change to white on a black background, circled in the highlight color as shown by marker indicia number 153. With this color combination it becomes much more apparent which patterns are formed—i.e., a player simply looks for the black background. Should a wrong indicia number be scratched, the indicia changes to white with a black outline on a white background circled in the highlight color as shown by marker indicia number 154. With this combination the consumer can readily recognize any mistakes.

Figure 7:
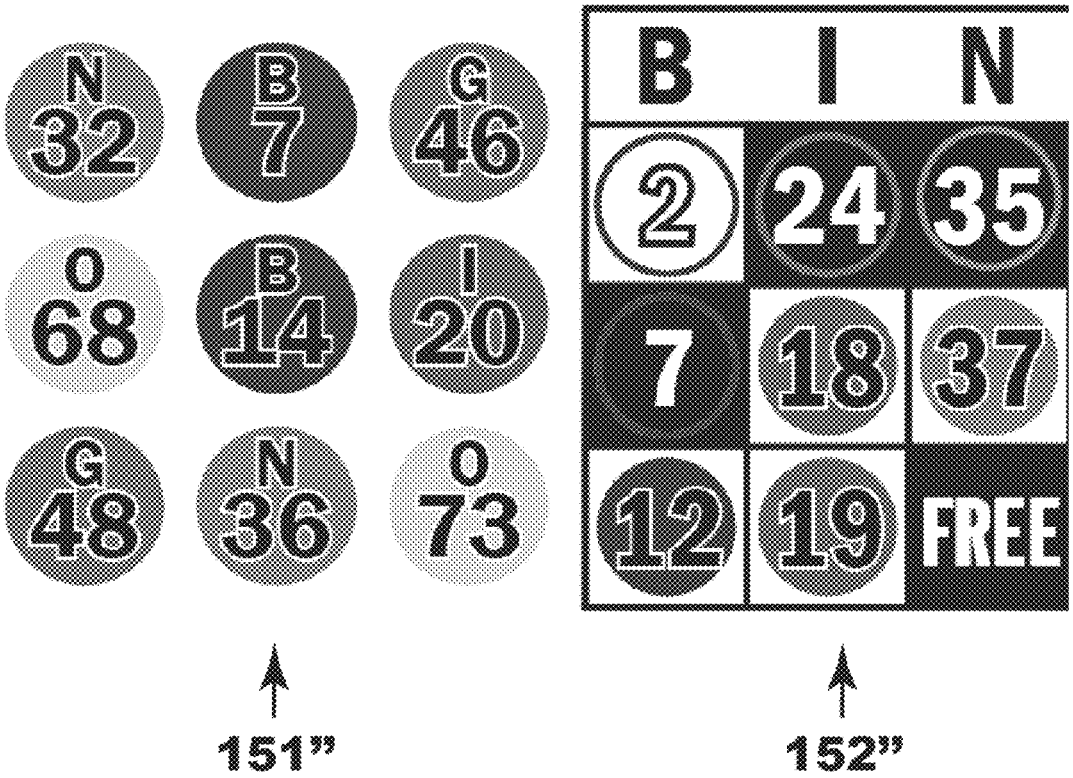
FIG. 7 is a magnified top plan view of a portion of the representative example of FIG. 6 with the SOC removed.

In a preferred embodiment for enhanced clarity, the call number letters and numbers indicia 151" and play card letters and numbers indicia 152" are outlined with a white stroke as shown in FIG. 7. With this embodiment, the outline has been designed such that a colorblind person will still be able to play the game as if it were just a monochromatic game—e.g., a black number on a color background appearing black would still illustrate the correct number due to the outline.

Figure 8:
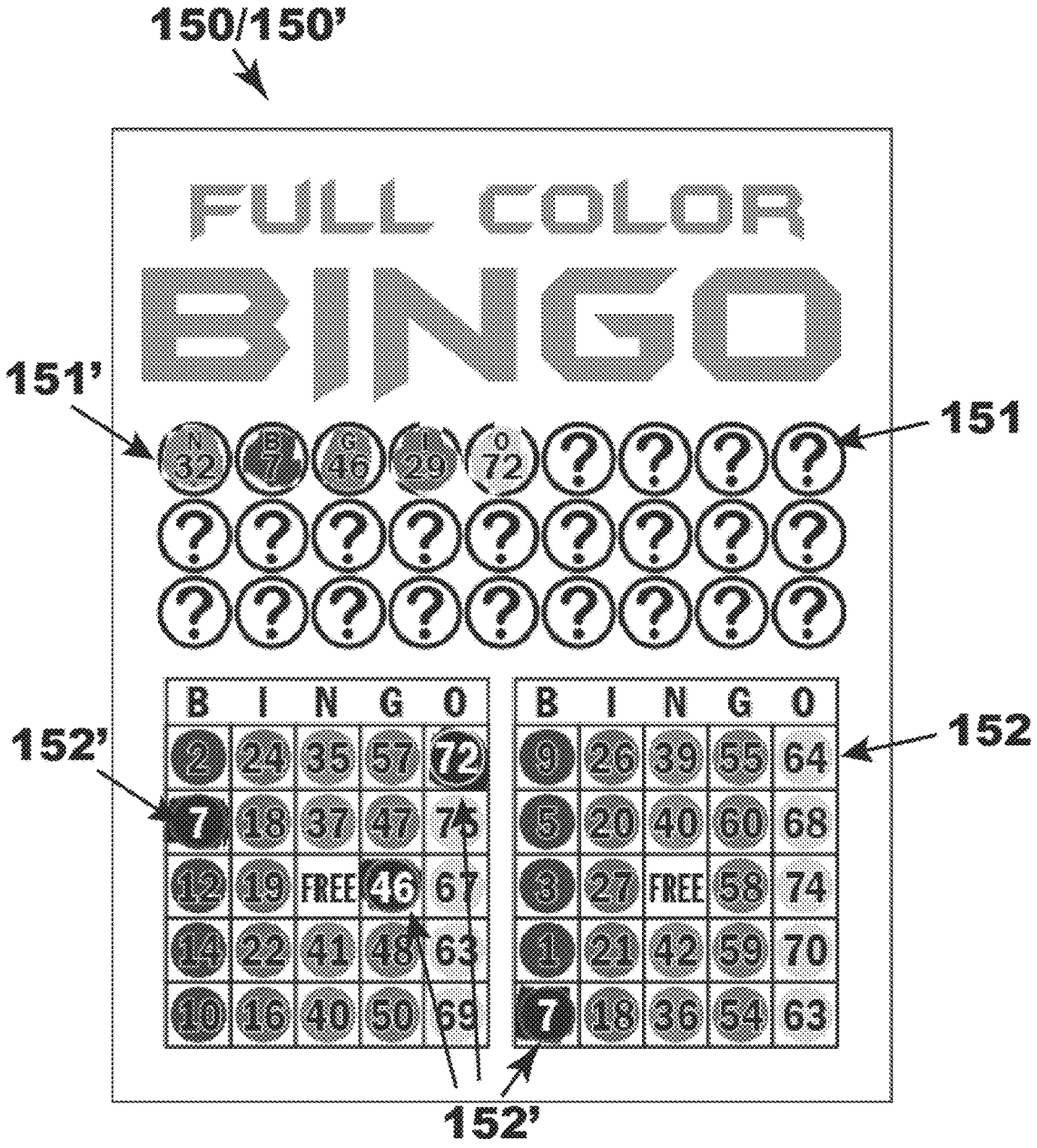
FIG. 8 is a top plan view of the representative example of FIG. 5 with the SOC partially removed.
Figure 9:
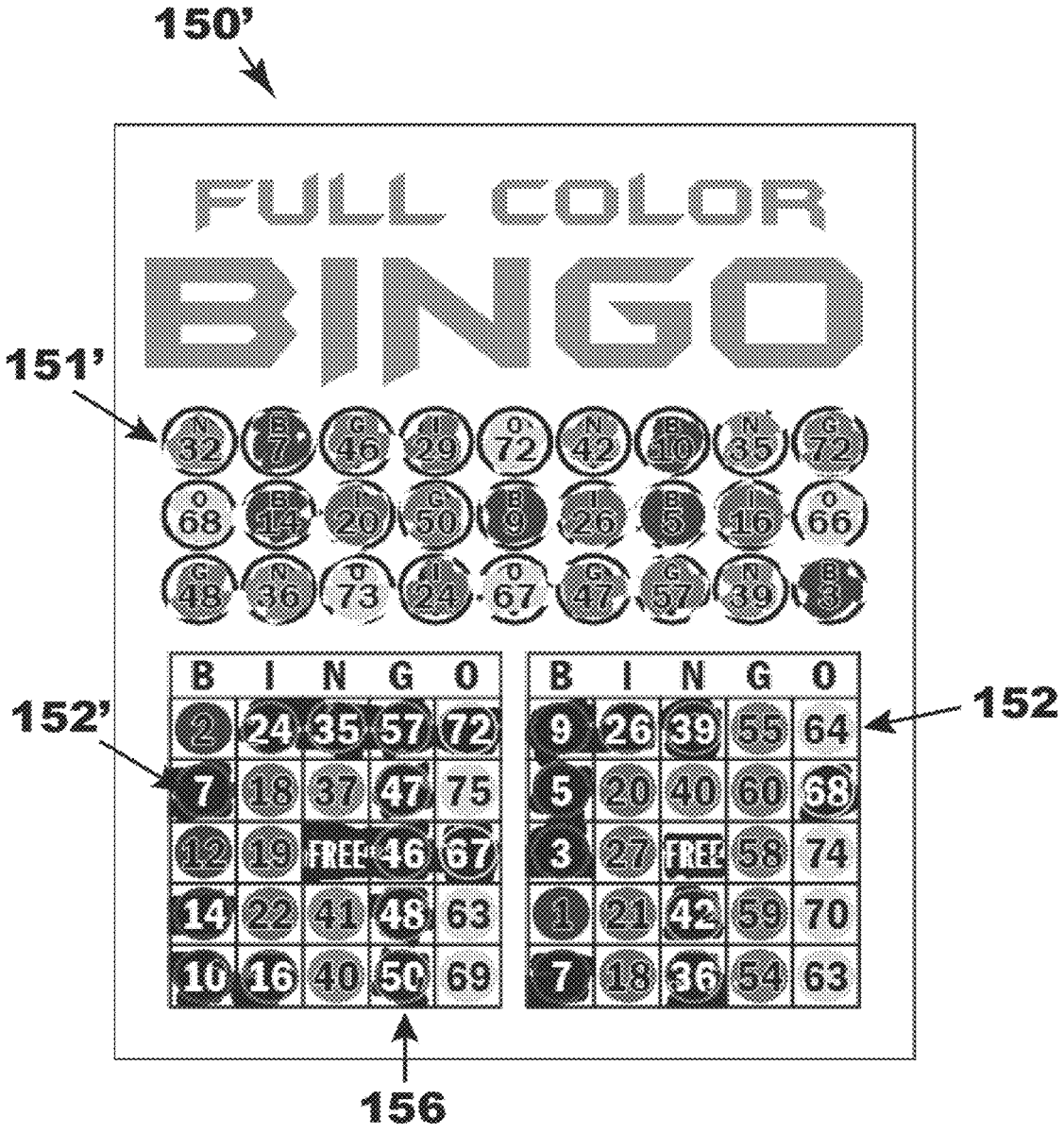
FIG. 9 is a top plan view of the representative example of FIG. 5 correctly played.
Figure 10:
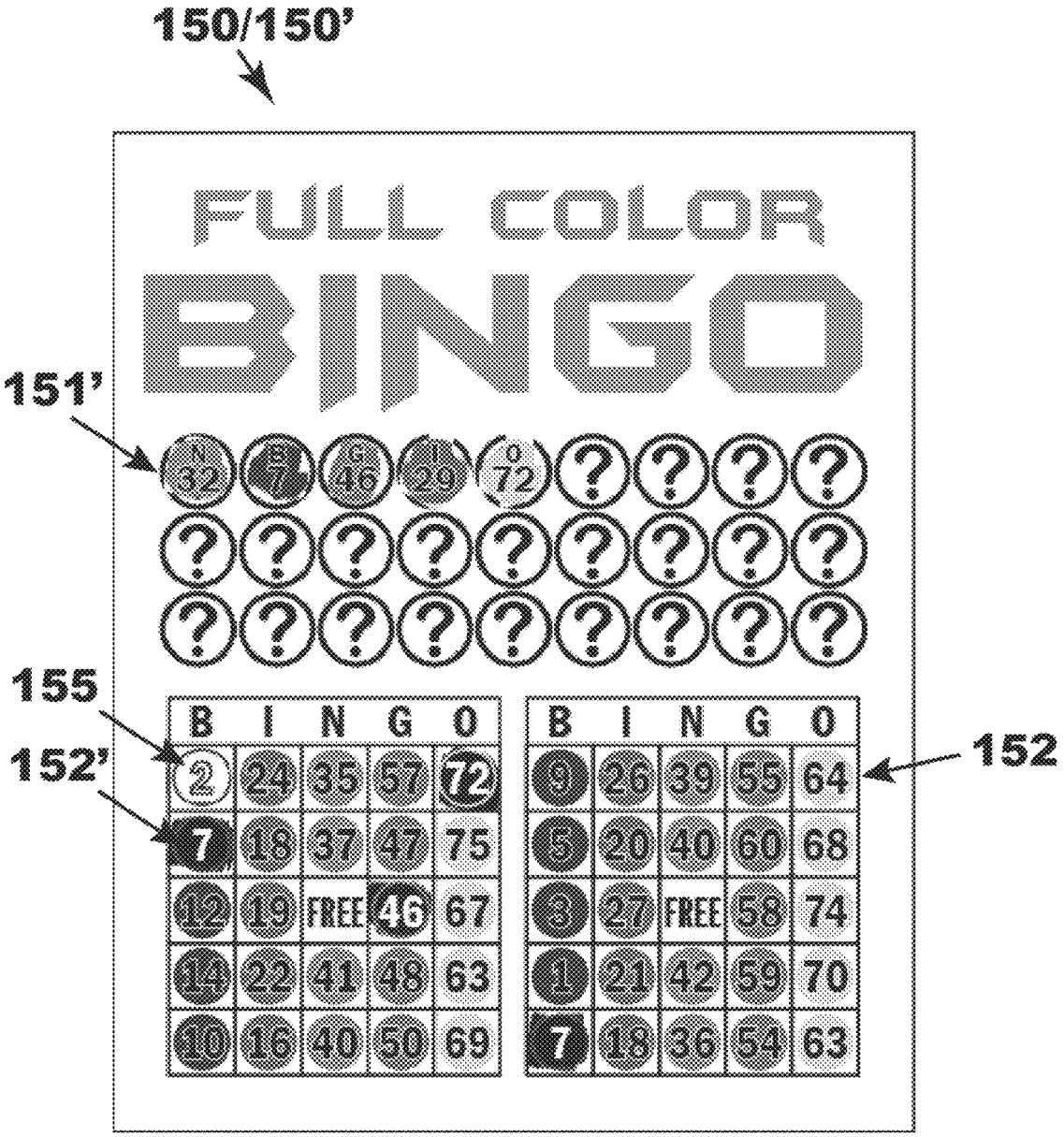
FIG. 10 is a top plan view of the representative example of FIG. 5 with the SOC of the call numbers partially played, but with the Bingo card spot "B2" mistakenly scratched-off.
Figure 11:
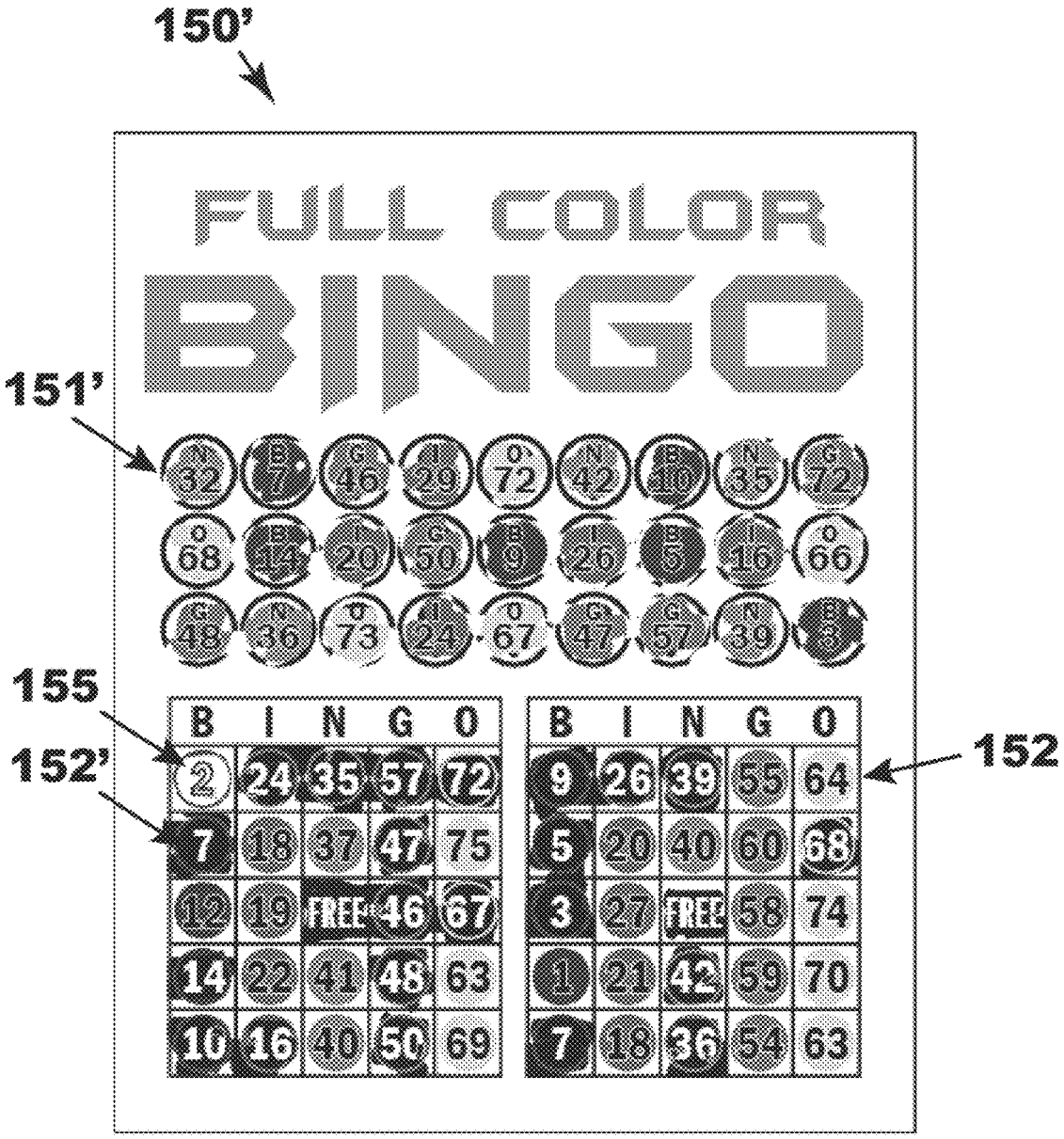
FIG. 11 is a top plan view of the representative example of FIG. 5 with the card fully played and the Bingo card spot "B2" mistakenly scratched-off.

FIG. 8 illustrates a partially played exemplary ticket 150/150' with the upper portion imaging and SOC removed as shown by call numbers 151' on five of the twenty-seven call number spots 151. Also illustrated in FIG. 8 are four play card lower imaging indicia numbers 152' corresponding to four of the five revealed call number indicia 151', the remaining play card indicia displaying the upper (unscratched) imaging 152 of the reveal. From a quick visual inspection of the partially played ticket it becomes readily apparent that the four play card indicia scratched as represented by play card numbers 152' are correct. FIG. 9 continues the process, illustrating a completely played exemplary ticket 150' with all of the upper portion imaging and SOC removed from the call numbers 151' and the SOC removed from the corresponding correct play card numbers 152'. As is readily apparent in the figure, there is one winning column 156 on the exemplary ticket 150'. In contrast, FIG. 10 and FIG. 11 illustrate partially played and completely played (respectively) versions of exemplary ticket 150' with one play card number 155 accidentally, but mistakenly scratched. As shown in the FIGS. 10 and 11, the scratch error at play number 155 is readily apparent. Thus, when a player is finished play, he or she can verify correct play by reviewing the exposed indicia, particularly indicia forming a winning Bingo. Alternatively, when a player is finished playing the game, he or she can simply scratch all or part of the upper portion imaging and SOC of any or all of the play cards to look for patterns the player missed.

It should be noted, however, that the examples provided in FIGS. 5 through 11 were for instructive purposes designed to readily convey the reveal invention. When designing reveal features that are a part of game play, caution should be exercised to ensure that the reveal features do not inadvertently provide opportunities for pin pricking attacks—i.e., where a very small portion of the SOC can be illicitly removed via pin pricking to determine the winning or losing status of the ticket, while still being able to sell the non-winning tickets to the consumer as unplayed due to the very small amounts of SOC removed not being readily apparent to a casual observer. For example, in FIGS. 5 through 11, the properly played designation(s) and associated color(s) could vary from ticket-to-ticket, thereby providing a countermeasure to pin pricking attacks.

There are other embodiments of variable reveal features that are an integral part of instant game play dynamics. For example, the upper portion imaging overlying the SOC can vary from ticket-to-ticket with the associated lower portion imaging with its variable reveal indicia varying in the degree of registration and alignment with the overprint, while these overprint or indicia variances still adhere to a common association with the game theme. With this type of variable reveal feature game, ticket variety is achieved including the actual play mechanic without necessarily influencing the prize fund.

Figure 12:
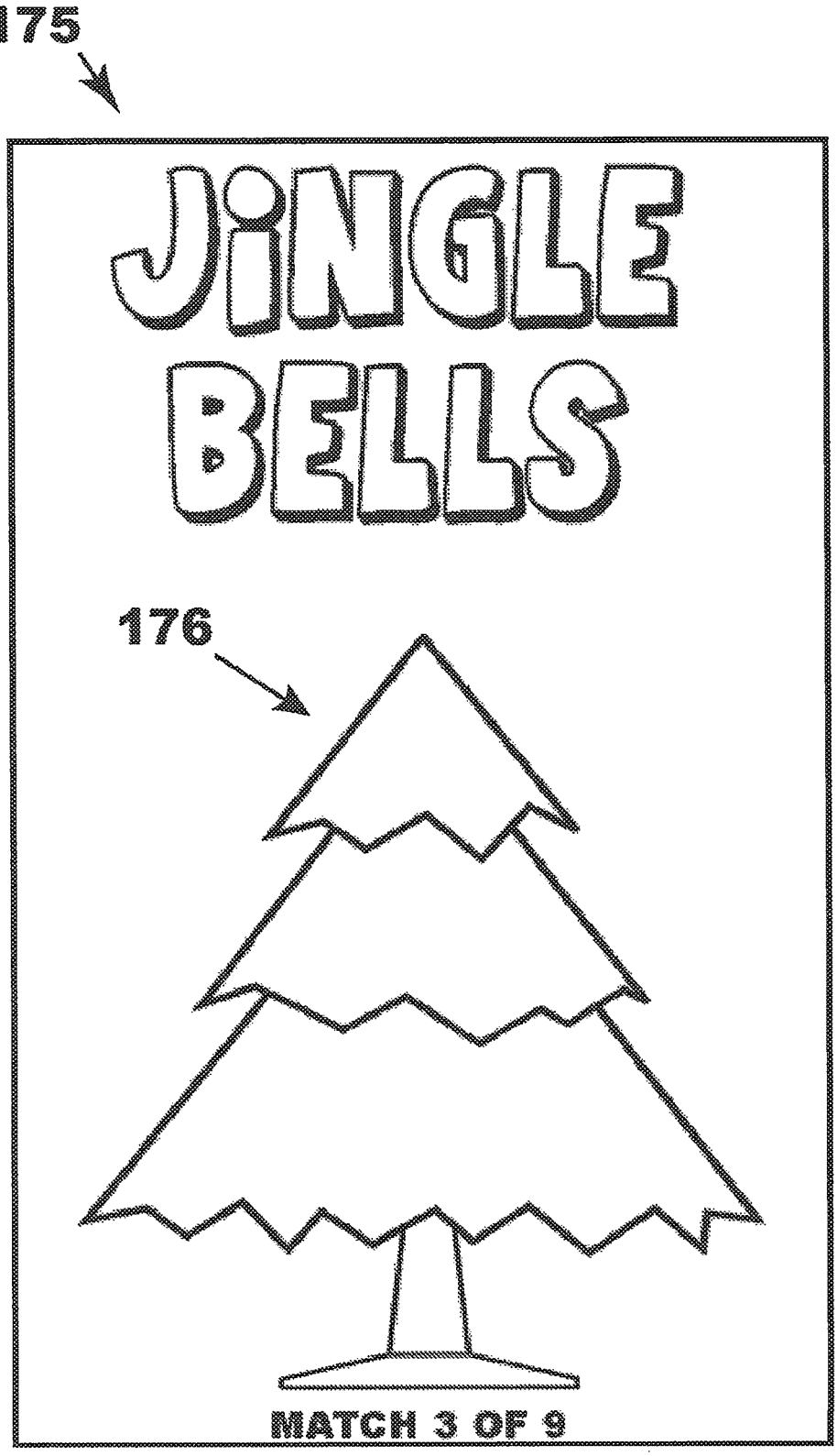
FIG. 12 is a top plan view of a second representative example of a variable reveal game where the reveal feature is a part of the actual game play, with its upper portion imaging and SOC intact.

For example, FIG. 12 is a top plan view of an embodiment of an exemplary variable reveal game ticket 175 with its overprint upper imaging portion and SOC intact. As illustrated in the figure, in the embodiment of the game ticket 175, the "Match 3 of 9" game play overprint 176 is a variable full color image overprint (i.e., Christmas tree) registered and aligned with the lower portion imaging variable indicia hidden under the overprint 176. In this particular embodiment, the "Match 3 of 9" play mechanic (namely, the methodology of the game, such as document or ticket layout, rules, etc.) remains a mystery to the consumer, since there is no indication of where any of the lower portion imaging variable indicia are located under the SOC. While this embodiment 175 illustrates an undecorated tree as the overprint, it is understood that the tree overprint could vary from ticket-to-ticket with imaging that includes partial decorations, presents, etc., in a manner that the upper portion imaging is associated with the lower portion imaging.

Figure 13:
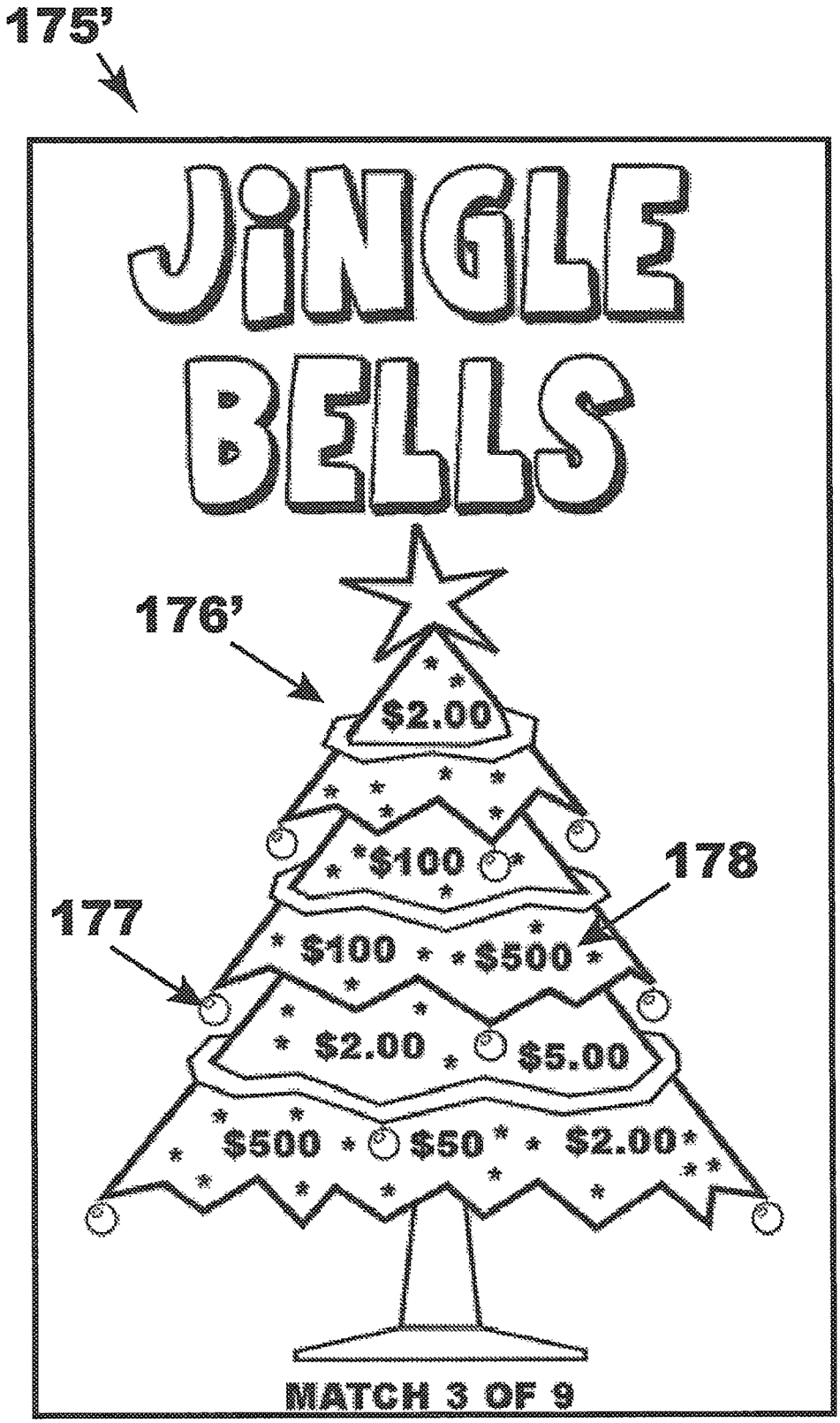
FIG. 13 is a top plan view of the second representative example of FIG. 12 with its SOC completely removed.

FIG. 13 illustrates the same exemplary top plan view of a ticket 175' as FIG. 12 of the embodiment of the ticket 175 with all of its overprint upper imaging portion 176 and SOC removed, revealing a fully decorated Christmas tree 176' comprised of multiple decorative lower portion imaging reveal features 177 and win or lose variable indicia 178. By imaging both the upper and lower reveal features with the same digital color printing techniques, the effect that the consumer visually perceives is a dissolve from the upper feature 175 to the lower feature 175' as he or she gradually removes the SOC.

Figure 14:
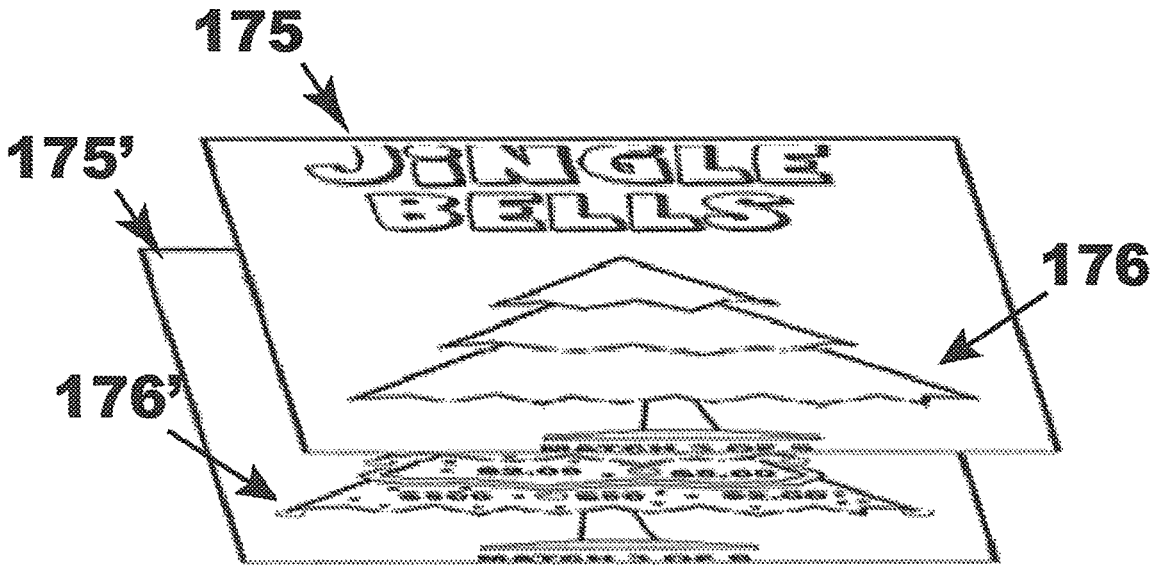
FIG. 14 is an exploded top front isometric schematic view of the representative examples of FIG. 13 and FIG. 14 illustrating the positioning of the upper variable reveal overprint with respect to the lower variable reveal indicia.

FIG. 14 is an exploded top front isometric view of this embodiment 175 showing its intact upper layer 176 and its associated lower layer 176' with the upper reveal feature 176 substantially aligned with its corresponding lower reveal feature 176'. Thus, for a reveal to effectively dissolve from an upper feature 176 to a lower feature 176', alignment and registration between the upper and lower imaging must be maintained as previously described with the first embodiment 100. However, in some embodiments, where the overprint image is not intended to necessarily dissolve into the lower indicia, as it is scratched-off, registration then becomes less critical.

Figure 15:
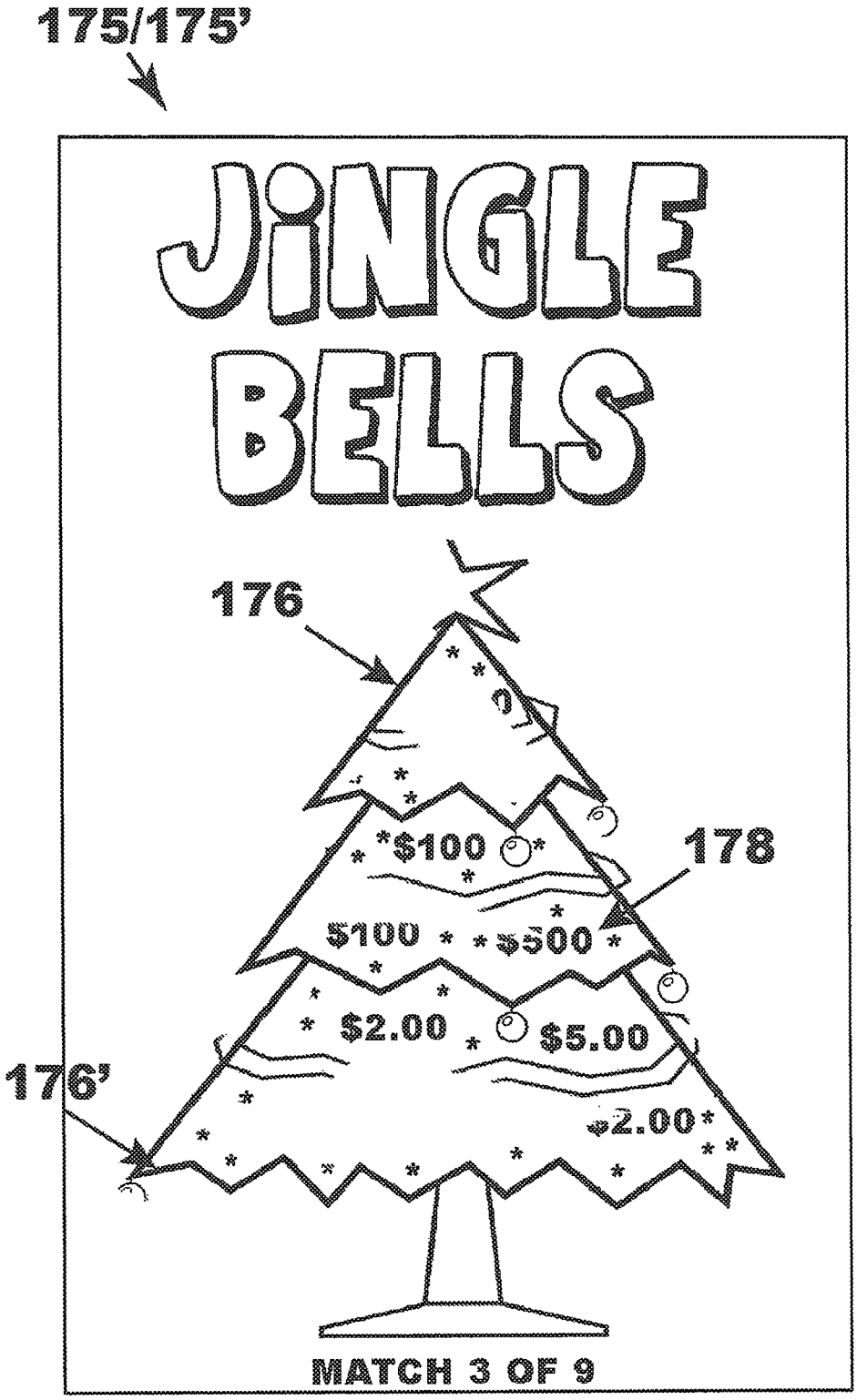
FIG. 15 is a is top plan view of the representative examples of FIG. 12 and FIG. 13 with the upper variable reveal overprint and associated SOC partially removed.

FIG. 15 illustrates a partial removal of the upper reveal feature 176 and SOC, emphasizing a portion of the lower reveal feature 176'. As illustrated in FIG. 15, the dissolve effect becomes apparent as the overprint upper portion imaging and SOC are gradually removed, revealing the lower portion imaging with its variable value or prize indicia 178. Thus, the essential concept among all of the embodiments is that the upper portion imaging and lower portion imaging reveal features are two full sets of process color graphics on the ticket, where the lower portion imaging graphic is revealed by scratching off the overprint upper portion imaging graphic printed on top of the SOC.

There are other variations of the disclosed embodiments that would be apparent to anyone skilled in the art in view of this disclosure. For example, the embodiment of the Bingo ticket 150 may illustrate different win/lose indicia than displayed in the drawings (e.g., color coded only with no black or reverse imaging), as a countermeasure to pin prick attacks. Another example would be to utilize the same type of reveal for the game of Battleship, where instead of having calling numbers, grid coordinate indicia can be revealed with the Bingo ticket play cards replaced by an ocean grid, etc.

What is claimed is:

1. A security-enhanced document comprising:

a substrate;

at least one lower portion imaged with first graphic indicia, the lower portion imaging being directly or indirectly digitally imaged on the substrate;

at least one release coat applied over the lower portion;

at least one scratch-off coating applied over the release coat to maintain the lower portion imaging unreadable until removal of the scratch-off coating; and at least one overprint upper portion digitally imaged with second graphic indicia over the scratch-off coating, the overprint upper portion being registered to cover at least a part of the imaging of the lower portion, the overprint upper portion being associated with the second graphic indicia of the lower portion, the upper portion having at least one associated feature imaged with respect to a visual or thematic aspect of the lower portion;

wherein the first and second graphic indicia include a portion having the same visual appearance and being in registration with each other, and the first graphic indicia includes another portion that does not appear in any portion of the second graphic indicia;

such that gradual removal of parts of the upper portion visually creates the appearance of the imaging on the upper portion dissolving visually or thematically into the lower portion imaging as a result of (i) the portion of the first and second graphic indicia having the same visual appearance and being in registration with each other remaining visually the same during removal due to the overprint upper portion being registered to cover at least a part of the imaging of the lower portion, and (ii) the portion of the first graphic indicia that does not appear in any portion of the second graphic indicia being revealed during the removal.

2. The document as in claim 1, wherein the imaging of the upper and lower portions is comprised of process colors.

3. The document as in claim 2, wherein the lower portion imaging and the upper portion imaging include an outline around the indicia to ensure legibility to colorblind individuals.

4. The document as in claim 1, wherein the imaging of the upper and lower portions is comprised of digitally imaged spot colors.

5. The document as in claim 4, wherein the lower portion imaging and the upper portion imaging include an outline around the indicia to ensure legibility to colorblind individuals.

6. The document as in claim 1, wherein the imaging of the upper and lower portions is a part of the game play and related to the value.

7. The document as in claim 6, wherein the imaging of the upper and lower portions provides a marker system indicating correct game play.

8. The document as in claim 1, wherein the registration of the imaging of the upper and lower portions is maintained within plus-or-minus 0.01 inch (0.254 mm) of each other.

9. The document as in claim 1, wherein the imaging of the upper and lower portions is not part of the game play and not related to the value.

10. The document as in claim 1 wherein the first graphic indicia is first variable indicia and the second graphic indicia is second variable indicia.

* * * * *